US005419458A

United States Patent [19]

Mayer

[11] Patent Number: 5,419,458

[45] Date of Patent: May 30, 1995

[54] TOY WATER GUN

[75] Inventor: Edward Mayer, Los Angeles, Calif.

[73] Assignee: Edward Mayer Design, Thousand Oaks, Calif.

[21] Appl. No.: 175,340

[22] Filed: Dec. 29, 1993

[51] Int. Cl.[6] ..... A63H 3/18

[52] U.S. Cl. ..... 222/79; 222/39; 222/324; 222/391

[58] Field of Search ..... 222/39, 79, 324, 391; 446/405, 473; 124/65, 66, 67

[56] References Cited

U.S. PATENT DOCUMENTS

| | | | |
|---|---|---|---|
| 1,782,479 | 11/1930 | Sadtler | 222/79 |
| 2,376,662 | 5/1945 | Cohen | 222/79 |
| 2,746,643 | 5/1956 | Spalding | 222/79 |
| 3,022,779 | 2/1962 | Benkoe | 222/79 X |
| 5,284,274 | 2/1994 | Lee et al. | 222/79 |

*Primary Examiner*—Andres Kashnikow

*Assistant Examiner*—Joseph A. Kaufman

*Attorney, Agent, or Firm*—John L. Rogitz

[57] ABSTRACT

A water gun has a housing and a cylinder mounted on the housing, with the cylinder being formed with an opening and defining a chamber. A piston is slidably disposed in the chamber and is spring biased to a fired position, wherein the piston is adjacent the opening. A reservoir is also mounted on the housing. A cocking member is movably mounted on the housing, and the cocking member can be manipulated to move the piston to a load position, wherein the piston is distanced from the opening of the cylinder and water from the reservoir can enter the chamber. Also, a firing mechanism is provided for releasing the piston to permit it to rapidly return to the fired position and thereby emit water from the chamber through the opening in a burst pattern, and to give an audible and tactile indication of water emission.

15 Claims, 5 Drawing Sheets

TOY WATER GUN

FIELD OF THE INVENTION

The present invention relates generally to toys, and more particularly to toy water guns.

BACKGROUND

Water guns are among the most popular of childs' toys. Given the competitiveness of the toy industry, it is not surprising that many types of water guns have been developed.

Traditionally, water guns were configured as pistols, and pistol water guns operate by means of a pressure build-up on water held in the pistol. The pressure build-up in such devices is induced by pulling a trigger on the pistol, and the pressurized water is expelled from the pistol through a nozzle.

Because the range and volume of water expelled in such water pistols is limited by the throw of the pistol trigger, relatively sophisticated water guns have been introduced for expanding both the range of water guns and the volume of the water stream that the water guns can produce. For example, U.S. Pat. No. 4,735,239 to Salmon et al. and U.S. Pat. No. 4,854,480 to Shindo disclose water guns that have elastic bladders for holding pressurized water and for releasing the water in a stream when a trigger on the water gun is pulled. Additionally, U.S. Pat. No. 4,214,674 to Jones et al. and U.S. Pat. No. 5,074,437 to D'Andrade et al. disclose water guns that pressurize water by establishing fluid communication between a water reservoir and an air reservoir, and providing means for pressurizing the air reservoir to expel water from the gun when the gun's trigger is pulled.

While some of the above-mentioned water guns have met with success, all unfortunately possess one or more structural and operational drawbacks. In the case of bladder-type guns, the bladder can rupture, thereby rendering the gun useless. Also, the range of bladder-type guns is somewhat limited, because the operating pressure of such guns is limited by the amount of expansion which the bladder can undergo.

Pressurized air guns, on the other hand, rely on a pressurized reservoir, and if the water tight integrity of the reservoir is compromised, e.g., by small cracks, the ability of the reservoir to hold pressure (and, thus, the range of the water gun) is reduced. Unfortunately, in the rough and tumble of child's play, the pressurized reservoirs often do become cracked.

Furthermore, all of the above-mentioned water guns emit water in a thin stream. While the range of the thin stream may vary from gun to gun, it is nevertheless a common characteristic of most water guns. Moreover, the above-mentioned water guns do not as a rule provide acoustic or tactile indications of water "firing". As recognized by the present invention, such non-visual indications of "firing", along with the capability to emit a large volume of water in a burst instead of the traditional thin stream, would greatly enhance the pleasure of a user of such a device.

Accordingly, it is an object of the present invention to provide a water gun which emits a relatively large volume of water. Another object of the present invention is to provide a water gun that emits a relatively large volume of water in a burst. Still another object of the present invention is to provide a water gun that provides tactile and acoustic indications of firing. Yet another object of the present invention is to provide a water gun that is easy to use and cost-effective to manufacture.

SUMMARY OF THE INVENTION

A water gun includes a housing and a trigger movably connected to the housing. A water cylinder is mounted on the housing, and the water cylinder forms a chamber for holding water. Also, the water cylinder has an end formed with an opening. A piston is slidably disposed in the chamber between a load position, wherein the piston is distanced from the opening, and a fired position, wherein the piston is adjacent the opening. To move the piston, a spring is operably engaged with the piston for urging the piston from the load position to the fired position in response to movement of the trigger to expel water from the chamber through the opening. In the preferred embodiment, the trigger is biased to a ready position and can be manipulated to move toward a shoot position.

Preferably, the water gun includes a water reservoir mounted on the housing and a conduit for selectively establishing a pathway for fluid communication between the chamber and reservoir. Also, a conduit check valve is disposed in the conduit for permitting one-way fluid flow from the reservoir to the chamber when the piston is moved toward the load position. Further, an opening check valve is disposed in the opening of the cylinder for permitting one-way fluid flow from the chamber through the opening when the piston is moved toward the fired position.

In the presently preferred embodiment, a cocking member is movably connected to the housing. The cocking member includes a manually grippable handle which has a cocked position and a shoot position, and the cocking member includes a shaft connected to the handle. A trunnion is operably engaged with the shaft such that the trunnion moves the piston from the fired position to the load position when the handle is moved from the shoot position to the cocked position.

As envisioned by the preferred embodiment, a pawl is movably mounted on the housing for preventing motion of the trigger when the handle of the cocking member is in the cocked position. Additionally, the pawl permits motion of the trigger when the handle of the cocking member is in the shoot position. In the preferred embodiment, the trunnion engages the pawl to move the pawl when the handle of the cocking member is moved toward the shoot position.

Moreover, the water gun includes a release arm that has a notch, and the release arm is movably mounted on the housing. The trigger moves the release arm when the trigger is moved toward the shoot position. Furthermore, a flange is formed on the piston, and a firing post is attached to the flange for selectively engaging the notch of the release arm to hold the piston in the load position.

When the trigger is moved toward the shoot position to move the release arm, the firing post is released from the notch to permit the piston to be moved toward the fired position by the spring. Advantageously, the flange of the piston strikes the trunnion when the piston is moved to the fired position, thereby generating an audible indication of firing and a tactile sensation of firing. A nozzle is engaged with the opening of the cylinder for emitting water from the chamber through the nozzle in a burst pattern when the piston is moved to the fired position.

In an alternate embodiment, a ratchet mechanism is operably associated with the cocking member and piston, and two springs are operably engaged with the ratchet mechanism. The ratchet mechanism has an engaged configuration and a released configuration, and the trigger can be operated to move the ratchet mechanism to the released configuration to permit the springs to urge the piston into the chamber.

In another aspect of the present invention, a device is disclosed for emitting water. The device of the present invention includes a reservoir and a liquid holder formed with an opening and defining a chamber. The liquid holder has a fill configuration, wherein water from the reservoir can pass into the chamber, and an expel configuration, such that water is rapidly expelled from the chamber through the opening in a burst pattern when the holder is moved toward the expel configuration. A firing mechanism is operably engaged with the liquid holder for selectively causing the liquid holder to emit water from the chamber.

In another aspect of the present invention, a method is disclosed for emitting water. In accordance with the present invention, a water gun is provided which has a cylinder that defines a chamber and has an opening. Also, the water gun includes a piston slidably disposed in the chamber, a water reservoir, a cocking member, and a firing mechanism. The piston is spring biased to a fired position, wherein the piston is adjacent the opening. Then, the cocking member is manipulated to move the piston to a load position, wherein the piston is distanced from the opening and wherein water in the reservoir can enter the chamber. Next, the firing mechanism is manipulated to permit the piston to move toward the fired position, thereby emitting water from the chamber through the opening.

The details of the present invention, both as to its construction and operation, can best be understood in reference to the accompanying drawings, in which like numerals refer to like parts, and which:

DETAILED DESCRIPTION OF THE PREFERRED EMBODIMENT

Figure 1:
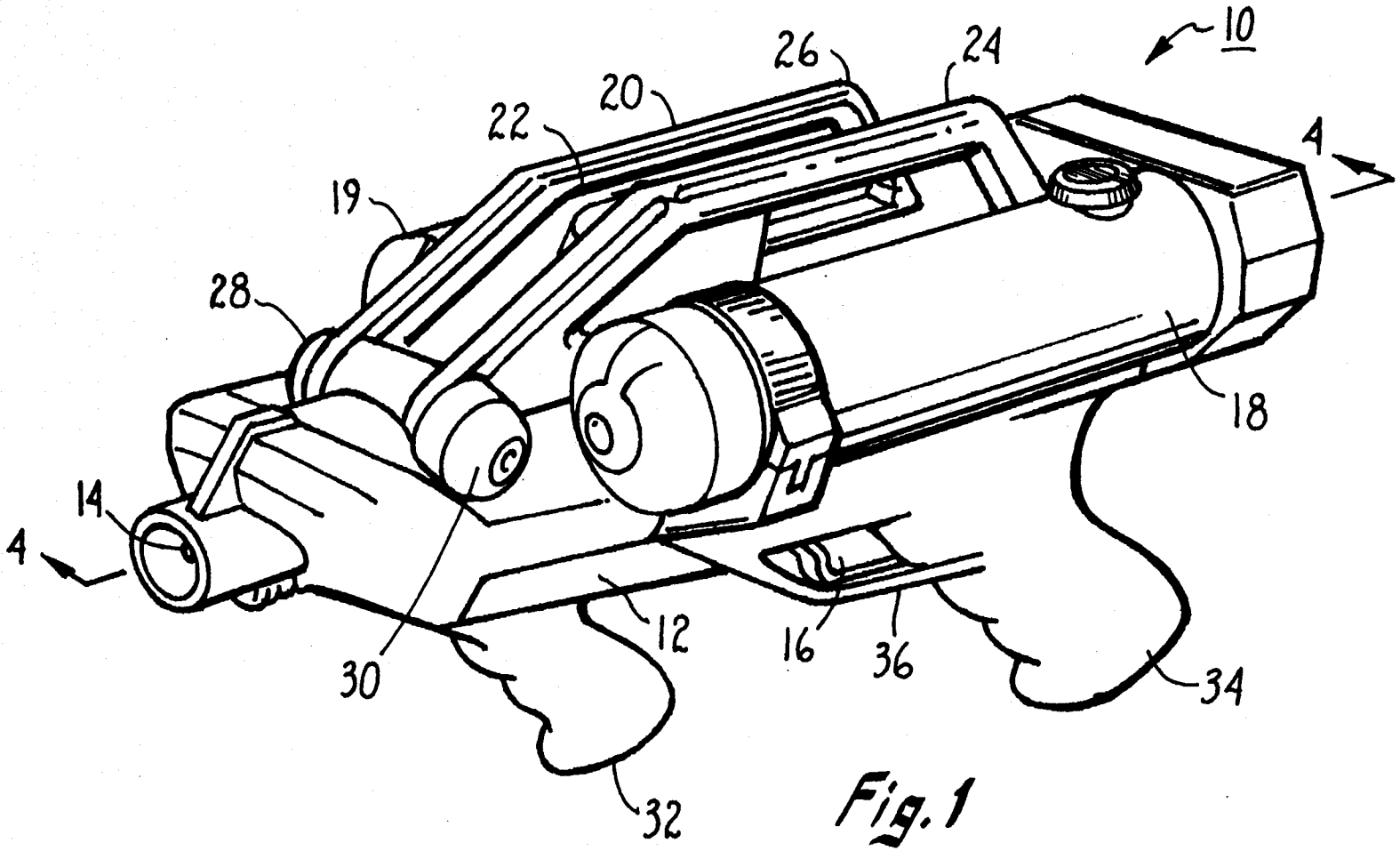
FIG. 1 is a perspective view of the water gun of the present invention.

Referring initially to FIG. 1, a water gun is shown, generally designated 10. As shown, the water gun 10 includes a plastic injection-molded housing 12 having a nozzle 14, and a trigger 16 is reciprocatingly mounted on the housing 12 by means well-known in the art. As discussed in further detail below, at least one and preferably two water reservoirs 18, 19 are removably mounted on the housing 12 by means well-known in the art, and the trigger 16 can be pulled by a person to cause water from the reservoirs 18, 19 to be expelled out of the nozzle 14 in a burst pattern. The water reservoirs 18, 19 are identical to each other, and for conciseness of disclosure only the water reservoir 18 shall be referred to in the disclosure below. Each reservoir 18, 19 preferably holds about sixteen (16) ounces of water.

A cocking member 20 is movably connected to the housing 12 to configure the water gun 10 for shooting a burst of water. As shown in FIG. 1, the cocking member 20 has a manually grippable handle 22 that has first and second halves 24, 26. Each half 24, 26 of the handle 22 is rotatably connected to the housing 12 at a respective rotation joint 28, 30. Consequently, the cocking member 20 can be pivoted about the joints 28, 30 relative to the housing 12. As more fully disclosed below, such pivotal movement of the cocking member 20 configures the water gun 10 for shooting water in a burst pattern.

FIG. 1 further shows that in one preferred embodiment, the housing 12 is formed with at least one and preferably a front and back knurled gun handle 32, 34. As shown in FIG. 1, the back gun handle 34 includes a trigger guard 36 for reducing the likelihood of unintended operation of the trigger 16, e.g., as might occur should the water gun 10 be dropped against a rigid object.

Figure 2:
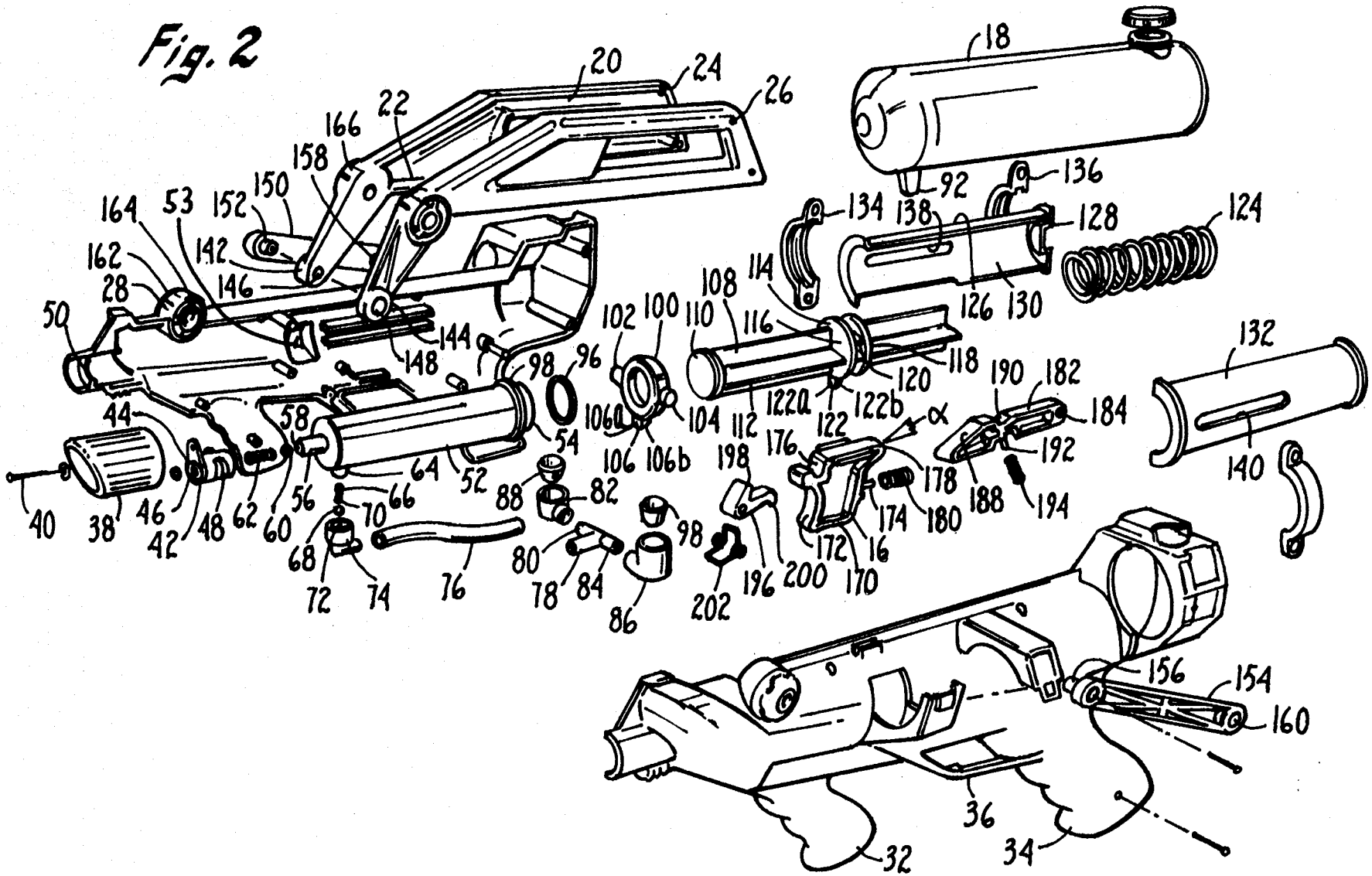
FIG. 2 is an exploded perspective view of the water gun of the present invention.

Now referring to FIG. 2, the details of the water gun 10 can be seen. As shown in FIG. 2, the nozzle 14 includes a cylindrical outer shell 38 that is surroundingly engaged with the housing 12 and is secured thereto by means well-known in the art, e.g., by an interference fit.

A nozzle element 42 is positioned in the shell 38, and the element 42 is held in the shell 38 by a threaded fastener 40. The nozzle element 42 may have a variety of configurations appropriate for producing a variety of spray patterns. In the embodiment shown, the nozzle element 42 is formed with concentric cylindrical outer and inner sleeves 44, 46, and the inner sleeve 46 is configured for directing water therethrough in a burst pattern. More specifically, the inner sleeve 46 has a cylindrical inside surface, an inside diameter of about a tenth of an inch (0.1"), and a length of about an eighth of an inch (0.125").

In contrast to the inner sleeve 46, the outer sleeve 44 is formed with an outwardly-protruding seating lip 48 which abuts a disc-shaped seating surface 50 formed on the housing 12.

FIG. 2 also shows that a hollow, generally cylindrically-shaped water cylinder 52 is mounted in the housing 12 by means well-known in the art e.g., by being received in part within a mounting cavity 53 which is formed on the housing 12. As can be appreciated in reference to FIG. 2, the water cylinder 52 defines a chamber 54. Also, the water cylinder 52 is formed with a hollow nipple 56 which is coaxial with the chamber 54, and the nipple 56 is engaged with the inner sleeve 46 of the nozzle element 42 in an interference fit. It is to be understood that the nipple 56 establishes a pathway for fluid communication between the chamber 54 of the water cylinder 52 and the nozzle element 42.

Furthermore, an opening check valve is disposed between the chamber 54 of the water cylinder 52 and the nozzle element 42 to permit fluid flow only from the chamber 54 toward the nozzle element 42. More particularly, the nipple 56 is formed with a frusto-conical inside surface 58, and a rigid metal or plastic ball 60 is urged toward the surface 58 by a compression spring 62 which in turn abuts the nozzle element 42.

Consequently, when fluid pressure plus the force of the spring 62 on the hemisphere of the ball 60 which faces the spring 62 equals or exceeds the fluid pressure on the hemisphere of the ball 60 which faces the chamber 54, the ball 60 is urged against the inside surface 58 of the nipple 56 to substantially prevent fluid flow from the nozzle element 42 to the chamber 54. On the other hand, when fluid pressure on the hemisphere of the ball 60 which faces the chamber 54 is sufficiently greater than the fluid pressure plus the force of the spring 62 on the hemisphere of the ball 60 which faces the nozzle element 42, the ball 60 is distanced from inside surface 58 of the nipple 56. Under such circumstances, fluid flow from the chamber 54 to the nozzle element 42 is permitted.

Still referring to FIG. 2, a conduit check valve is disposed between the chamber 54 of the water cylinder 52 and the water reservoirs 18, 19 to permit fluid flow only to the chamber 54 from the water reservoirs 18, 19. More particularly, a fill port 64 is formed in the water cylinder 52 to fill the cylinder 52 with water from the water reservoirs 18, 19, and a conduit check valve which includes a compression spring 66 is disposed in the fill port 64. As shown, a rigid metal or plastic ball 68 is positioned against an end 70 of the spring 66. Also, the ball 68 is received in a frusto-conical seat 72 that is formed on a fill cup 74.

Consequently, when fluid pressure plus the force of the spring 66 on the hemisphere of the ball 68 which faces the spring 66 equals or exceeds the fluid pressure on the hemisphere of the ball 68 which faces the seat 72 of the cup 74, the ball 68 is urged against the seat 72 to substantially prevent fluid flow from the cup 74 to the chamber 54 (i.e., fluid flow through the fill port 64 is prevented). On the other hand, when fluid pressure on the hemisphere of the ball 68 which faces the cup 74 is sufficiently greater than the fluid pressure plus the force of the spring 66 on the hemisphere of the ball 68 which faces the chamber 54, the ball 68 is distanced from seat 72 of the cup 74. Under such circumstances, fluid flow from the cup 74 to the chamber 54 of the water cylinder 52 (i.e., fluid flow through the fill port 64) is permitted.

FIG. 2 additionally shows that a fluid line 76 is connected to the fill cup 74. The fluid line 76 can be made of any suitable material known in the art, e.g., flexible plastic. In turn, the fluid line 76 is connected to a hollow "T" fitting 78.

As shown in FIG. 2, the "T" fitting 78 has a first arm 80 that is connected to a first hollow "L" fitting 82, and a second arm 84 that is connected to a second hollow "L" fitting 86. A respective hollow strainer 88, 90 is disposed in each "L" fitting 82, 86, and the strainers 88, 90 respectively receive fluid ports that are formed on the water reservoirs 18, 19 (only fluid port 92 shown). Accordingly, a pathway for fluid communication between the water reservoir 18 is established through the fluid port 92, strainer 88, "L" fitting 82, first arm 80 of the "T" fitting 78, fluid line 76, cup 74, and fill port 64 into the chamber 54 of the water cylinder 52. Likewise, a pathway for fluid communication between the water reservoir 19 is established through its fluid port (not shown), strainer 90, "L" fitting 86, second arm 84 of the "T" fitting 78, fluid line 76, cup 74, and fill port 64 into the chamber 54 of the water cylinder 52.

FIG. 2 further shows that a resilient rubber or plastic O-ring 96 is positioned around the water cylinder 52 in an abutting relationship with an annular seating flange 98 that is formed on the water cylinder 52. An annular trunnion 100 can abut the O-ring 96, as more fully disclosed below.

As shown in FIG. 2, the trunnion 100 is formed with opposed first and second cylindrically-shaped outwardly-projecting trunnion elements 102, 104. Also, the trunnion 100 is formed with a right-triangularly-shaped safety enabler 106. As shown, the safety enabler 106 is positioned on the trunnion 100 intermediate the trunnion elements 102, 104, and a safety catch surface 106*a* of the safety enabler 106 is perpendicular to the long axis of the water gun 10 and faces the water cylinder 52. A ratchet surface 106*b* of the safety enabler 106 is oriented obliquely to the long axis of the water gun 10 and is generally opposed to the safety catch surface 106*a*.

As can be appreciated in reference to Figures FIG. 2, the trunnion is sized for slidably receiving a piston 108. Together, the piston 108 with water cylinder 52 establish a liquid holder. As shown, the piston 108 is formed with a disc-shaped head 110 and an elongated ribbed shaft 112.

Also, a contact flange 114 is formed on the shaft 112. The contact flange 114 includes a front surface 116, a back surface 118, and a plurality of spacers 120 formed therebetween. Additionally, a right-triangularly-shaped firing post 122 is formed on the contact flange 114 and depends downwardly from the flange 114, and a catch surface 122*a* of the firing post 122 is perpendicular to the long axis of the water gun 10 and faces the head 110 of the piston 108. A ratchet surface 122*b* of the firing post 122 is oriented obliquely to the long axis of the water gun 10 and is generally opposed to the catch surface 122*a*.

As shown in FIG. 2, an activating spring 124 is positioned against the back surface 118 of the contact flange 114. Preferably, the activating spring 124 is made of steel, plastic, or rubber, and has a relatively high spring constant. The spring 124 is disposed in compression in a hollow cylindrical spring holder 126 between a back wall 128 of the holder 126 and the back surface 118 of the contact flange 114. In turn, the spring holder 126 is mounted within the housing 12.

It is to be understood in reference to FIG. 2 that the head 110 of the piston 108 is slidably received in the chamber 54 of the water cylinder 52. It is to be further understood that the trunnion 100 can be urged against the front surface 116 of the contact flange 114 of the piston 108 to move the piston 108 away from the chamber 54, against the spring 124. The spring 124 in turn urges the contact flange 114 (and, hence, the piston 108) into the chamber 54 of the water cylinder 52.

Still referring to FIG. 2, the spring holder 126 is preferably made of first and second molded holder halves 130, 132. As shown in FIG. 2, the halves 130, 132 are held together by first and second C-clamp pairs 134, 136, and the individual C-shaped halves of each C-clamp pair 134, 136 are held together by means well known in the art, e.g., by screws.

FIG. 2 shows that the halves 130, 132 of the spring holder 126 are respectively formed with elongated channels 138, 140. The trunnion elements 102, 104 of the trunnion 100 are slidably received in the channels 138, 140, respectively, and extend therethrough for purposes to be shortly disclosed.

FIG. 2 further shows that the first and second halves 24, 26 of the handle 22 of the cocking member 20 terminate in respective ends 142, 144. Each end 142, 144 is formed with a respective circular opening 146, 148. A first rigid plastic elongated shaft 150 is formed with an inwardly-protruding pin 152, and the pin 152 is rotatably engaged with the opening 146 of the first handle half 24. Similarly, a second rigid plastic elongated shaft 154 is formed with an inwardly-protruding pin 156, and the pin 156 is rotatably engaged with the opening 148 of the second handle half 26.

Further, each shaft 150, 154 is formed with a respective trunnion opening 158, 160 opposite the associated pin 152, 156. The trunnion elements 102, 104 are respectively rotatably engaged with the trunnion openings 158, 160 of the shafts 150, 154.

It may also now be seen in reference to FIG. 2, taking the joint 28 as an example, that the joint 28 consists of concentric engagement cylinders 162, 164 that are formed on the housing 12, and complementary engagement cylinders (only cylinder 166 shown) that are formed on the handle 22. The engagement cylinders 162, 164 formed on the housing 12 rotatably engage the engagement cylinders that are formed on the handle 22.

The water gun 10 also includes a firing mechanism that is operably engaged with the piston 108 for selectively causing the piston 108 to push water from the chamber 54. In the embodiment shown, the firing mechanism includes the trigger 16 which is pivotally or, more preferably, reciprocally mounted on the housing 12. The trigger 16 is formed with a curvilinear finger surface 172, and a person moves the trigger 16 by urging against the finger surface 172. Also, the trigger 16 is formed with a cylindrical spring post 174 opposite the finger surface 172, and a notch 176 is formed on the trigger 16. Moreover, the trigger 16 includes a contact corner 178 which defines an acute angle $\alpha$.

A trigger spring 180 is positioned in the housing 12, and the spring 180 surroundingly engages the post 174. As shown, the trigger spring 180 is disposed in compression between the housing 12 and the trigger 16, to urge the trigger 16 toward a ready position, shown in FIG. 2. A person can depress (i.e., pull) the trigger 16 by urging against the finger surface 172 to move the trigger 16 to a fired position.

FIG. 2 shows that a release arm 182 is pivotally mounted on the housing 12. More particularly, the release arm 182 is formed with a hole 184, and a shaft (not shown) is formed on the housing 12 and extends through the hole 184. A slanted surface 188 is formed on the release arm 182 generally opposite the hole 184. As shown, the surface 188 establishes an obtuse angle with respect to the long axis of the water gun 10.

Additionally, the release arm 182 includes a notch 190 and a cylindrical post 192 formed generally opposite to the notch 190. An arm spring 194 is surroundingly engaged with the post 192, and the spring 194 is mounted in compression between the housing 12 and release arm 182 to urge the slanted surface 188 of the release arm 182 toward the piston 108.

Moreover, a safety pawl 196 is rotatably engaged with the housing 12. The safety pawl 196 has a first engagement surface 198 and second engagement surface 200, and a spring 202 urges the second engagement surface 200 into engagement with the notch 176 of the trigger 16. Thereby, reciprocal movement of the trigger 16 (and, hence, firing of the water gun 10) is prevented.

On the other hand, when the cocking member 20 is moved to the shoot position, the safety enabler 106 abuts the first engagement surface 198 to move the pawl 196 to a ready position in which the pawl 196 does not engage the trigger 16, thus enabling firing of the water gun 10.

The operation of the water gun 10 may now be appreciated in cross-reference to FIGS. 2–6. With the cocking member 20 in the shoot position and the piston 108 in the fired position shown in FIG. 6, the cocking member 20 is moved to a cocked position (shown in FIG. 3).

Such movement causes the shafts 150, 154 to move the trunnion 100 against the contact flange 114 of the piston 108 and against the force of the spring 124. Consequently, the piston 108 is moved from the fired position shown in FIG. 6, wherein the head 110 of the piston 108 is adjacent the nozzle 14, to the load position shown in FIGS. 3 and 4, wherein the head 110 of the piston 108 is distanced from the nozzle 14.

Figure 3:
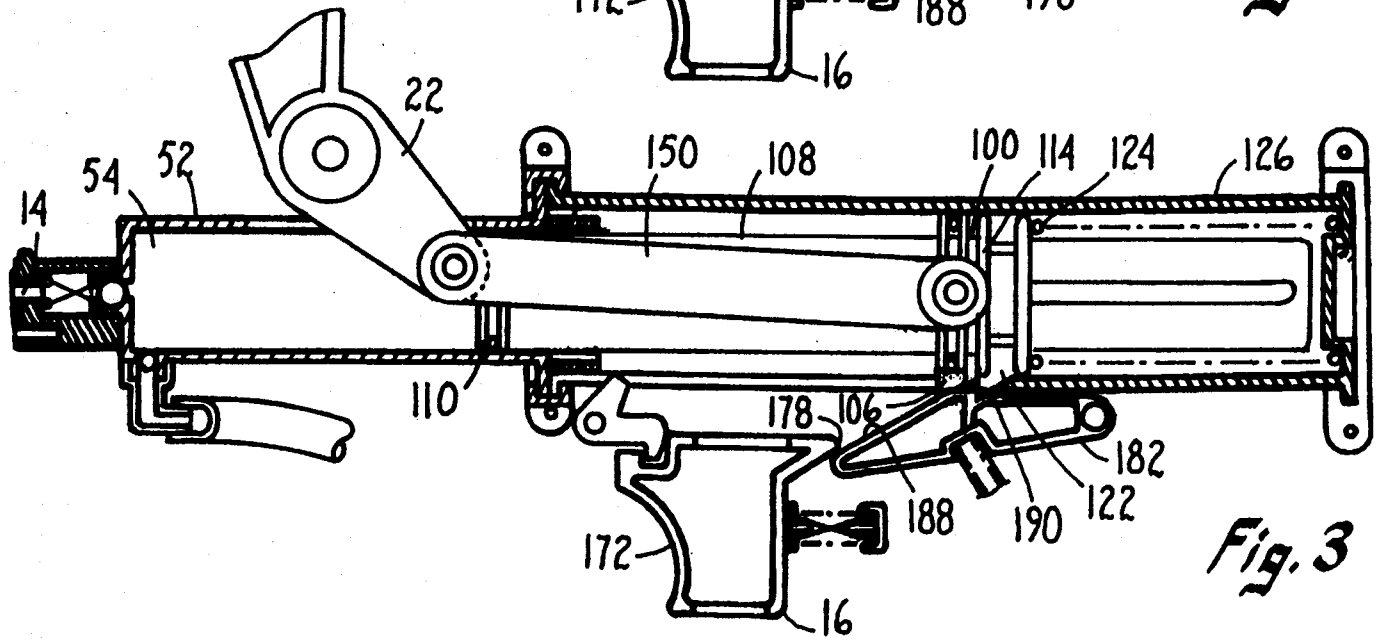
FIG. 3 is a partial side cross-sectional view showing the firing mechanism of the water gun, as would be seen along the line 4—4 in FIG. 1, with the cocking member in the cocked position and the piston in the load position with the safety engaged.

Further, while the cocking member 20 is in the cocked position shown in FIG. 3, the second engagement surface 200 of the pawl 196 engages the notch 176 of the trigger 16. Thereby, reciprocal movement of the trigger 16 (and, hence, firing of the water gun 10) is prevented.

Figure 4:
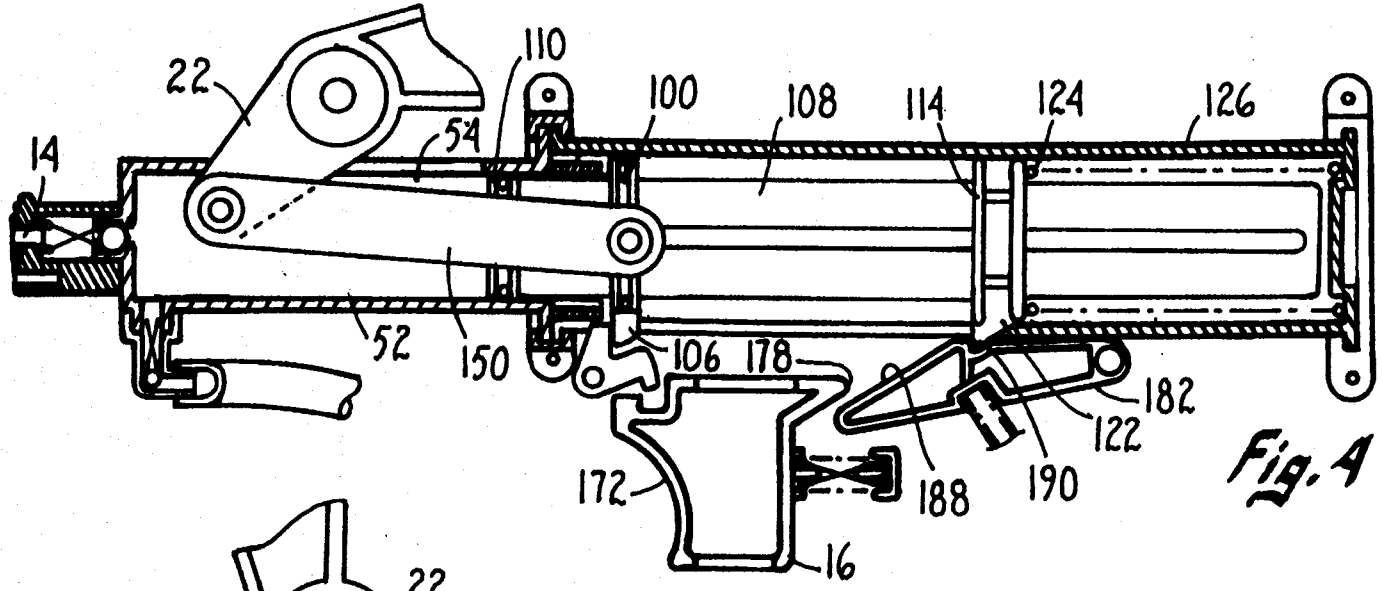
FIG. 4 is a partial side cross-sectional view showing the firing mechanism of the water gun, as seen along the line 4—4 in FIG. 1, with the cocking member in the shoot position and the piston in the load position with the safety disengaged.

Next, the cocking member 20 is moved back to the shoot position to configure the water gun 10 as shown in FIG. 4. Thereby, the safety enabler 106 of the trunnion 100 abuts the first engagement surface 198 to move the pawl 196 to a ready position in which the pawl 196 does not engage the trigger 16, thus enabling firing of the water gun 10.

Figure 5:
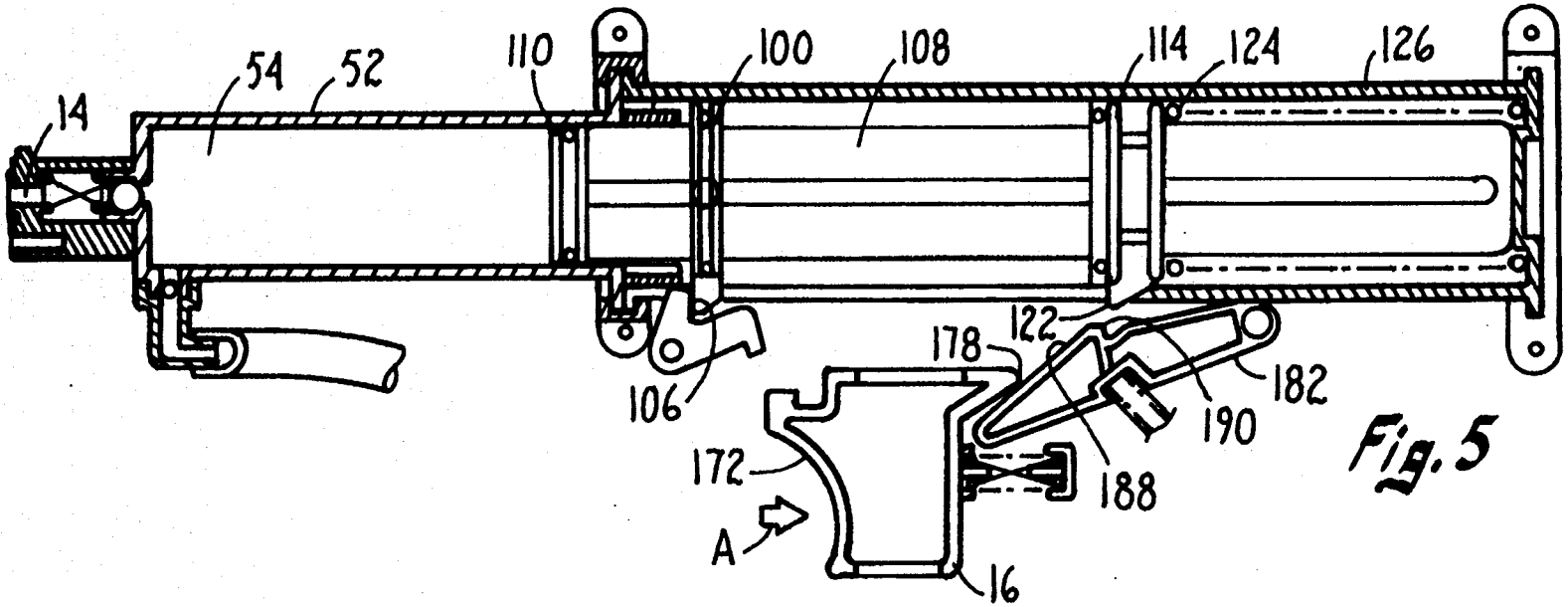
FIG. 5 is a partial side cross-sectional view showing the firing mechanism of the water gun, as would be seen along the line 4—4 in FIG. 1, showing the piston in the load position with the safety disengaged, immediately subsequent to pulling the trigger.
Figure 6:
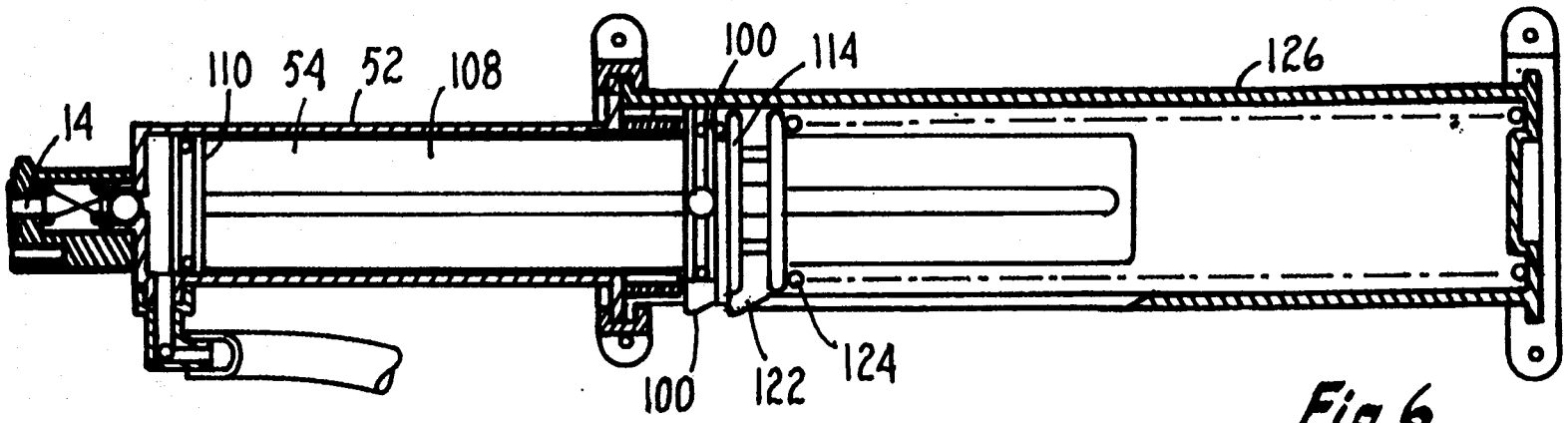
FIG. 6 is a partial side cross-sectional view of the piston and cylinder as would be seen along the line 4—4 in FIG. 1, with the piston in the fired position subsequent to expelling water from the chamber.

It may be further appreciated that the notch 190 of the release arm 182 is configured for engaging the catch surface **122*a* of the firing post 122, to hold the piston 108 in the cocked position shown in FIGS. 3 and 4. Then, the trigger 16 can be moved toward the release arm 182, i.e., in the direction indicated by the arrow "A" in FIG. 5. As shown in FIG. 5, the cooperation of structure between the contact corner 178 of the trigger 16 and the slanted surface 188 of the release arm 182 causes the release arm 182 to pivot. Consequently, the notch 190 of the release arm 182 is distanced from the firing post 122, which allows the spring 124 to rapidly urge the piston 108 into the chamber 54, i.e., toward the position shown in FIG. 6. Water is thereby expelled through the nozzle 14** in a burst pattern.

It may also now be appreciated that as the cocking member 20 is moved from the shoot position to the cocked position (FIG. 3) to thereby move the piston 108 to the load position, the cooperation of structure between the head 110 of the piston 108 and the chamber 54 tends to create a slight relative vacuum in the chamber 54. Consequently, water from the reservoirs 18, 19 distances the ball 68 of the conduit check valve from the seat 72 and enters the chamber 54.

Figure 7:
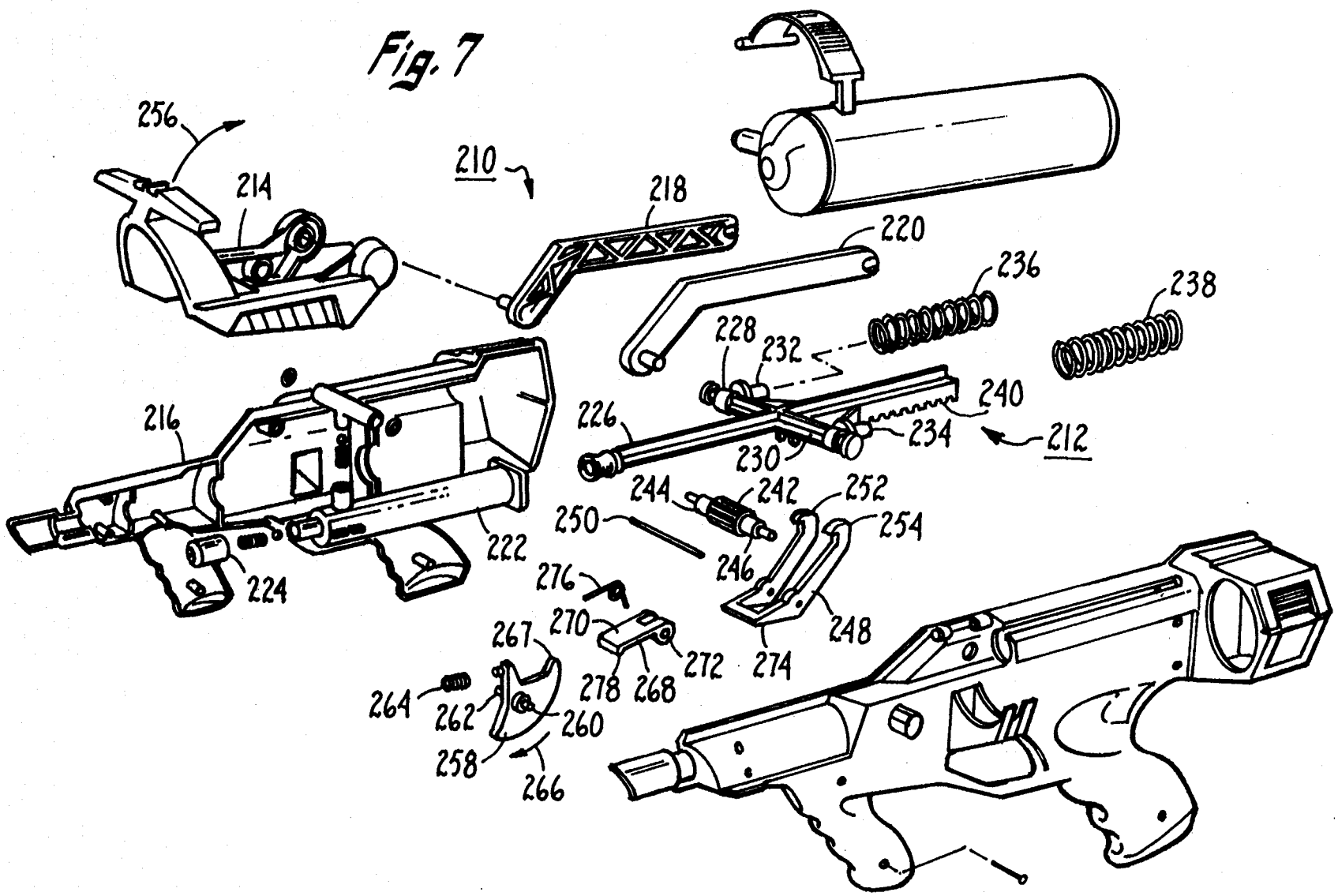
FIG. 7 is an exploded perspective view of an alternate embodiment of the water gun of the present invention which has a ratchet mechanism.

FIG. 7 shows a water gun, generally designated 210, which includes a ratchet mechanism, generally designated 212. As shown, a handle 214 is pivotally engaged with a housing 216, and the handle 214 is also engaged with shafts 218, 220.

A hollow water cylinder 222 is mounted in the housing 216, and a nozzle 224 is positioned in fluid communication with the water cylinder 222. A piston 226 is slidably disposed in the water cylinder 222 for rapidly expelling water from the cylinder 222 through the nozzle 224.

The piston 226 is formed with first and second opposed arms 228, 230 which are perpendicular to the long axis of the piston 226. Each arm 228, 230 is formed with a respective engagement cylinder 232, 234. Relatively strong compression springs 236,238 are respectively engaged with the engagement cylinders 232, 234.

Also, the shafts 218, 220 are respectively engaged with the first and second arms 228,230 of the piston 226. Accordingly, the handle 214 can be cocked (i.e., pulled in the direction indicated by the arrow 256) to push the arms 228, 230 of the piston 226 away from the water cylinder 222, against the springs 236, 238. It is to be understood that when the handle 214 is pushed back, i.e., when the handle 214 is moved in the direction opposite that indicated by the arrow 256, the shafts 218,220 disengage the first and second arms 228, 230 of the piston 226.

As further shown in FIG. 7, a rack gear 240 is formed on the piston 226. Also, a pinion gear 242 is rotatably mounted in the housing 216, and the pinion gear 242 engages the rack gear 240. Thus, as the piston 226 is moved away from the water cylinder 222, the cooperation of structure between the rack gear 240 and pinion gear 242 causes the pinion gear 242 to rotate.

As shown in FIG. 7, the pinion gear 242 includes first and second opposed pawls 244, 246. A ratchet 248 is pivotally mounted on the housing 216 via a mounting pin 250, and the ratchet 248 includes first and second ratchet arms 252,254 which respectively ratchetably engage the pawls 244, 246 as the pinion gear 242 rotates.

Accordingly, as the skilled artisan will appreciate, the ratchet mechanism 212 disclosed above permits a relatively weak person, e.g., a small child, to cock the water gun 210 against the force of the springs 236, 238 in small stages. Specifically, a person can incrementally move the handle 214 in the direction indicated by the arrow 256 to incrementally distance the arms 228, 230 of the piston 226 from the water cylinder 222. After each incremental movement of the handle 214, the person can pause, and the ratchet mechanism 212 holds the piston 226 stationary, thereby preventing the springs 236, 238 from urging the piston 226 toward the nozzle 224.

A firing mechanism is also provided to release the ratchet 248 from the pawls 244, 246 and thereby permit the springs 236, 238 to rapidly urge the piston 226 toward the nozzle 224 to expel water from the water cylinder 222. The firing mechanism includes a trigger 258 which is pivotally mounted in the housing 216 by opposed mounting pins 260, 262. As shown, the pins 260, 262 are formed on the trigger 258, and a spring 264 urges against the trigger 258 to cause the trigger 258 to tend to pivot about the pins 260, 262 in the direction indicated by the arrow 266. Additionally, the trigger 258 is formed with an abutment 267.

FIG. 7 also shows that a ratchet release element 268 is formed with a contact surface 270 and a channel 272. The contact surface 270 is positioned against a bottom surface 274 of the ratchet 248, and the shaft 250 extends through the channel 272. A spring 276 holds the contact surface 270 of the release element 268 against the bottom surface 274 of the ratchet 248.

Moreover, the release element 268 is formed with a lip 278. It is to be understood that the lip 278 is configured for engaging the abutment 267 of the trigger 258 when the trigger 258 is pivoted against the force of the spring 264.

With the above-described combination of structure, the water gun 210 can be ratchetably cocked by pulling the handle 214 from a shoot position to a cocked position, i.e., by pulling the handle 214 in the direction indicated by the arrow 256. As the handle 214 is pulled, the pinion gear 242 is rotated by the rack gear 240. In turn, the pawls 244,246 of the pinion gear 242 ratchetably engage the ratchet arms 252,254 of the ratchet 248, enabling a person to incrementally cock the water gun 210.

Once the water gun 210 has been cocked as described above, the handle 214 is returned to the shoot position. Then, the trigger 258 is pulled to cause the trigger 258 to pivot in a direction opposite the direction indicated by the arrow 266. As the trigger 258 is pulled, the abutment 267 of the trigger 258 urges upwardly against the lip 278 of the release element 268 to urge the contact surface 270 of the element 268 against the bottom surface 274 of the ratchet 248.

When the contact surface 270 of the release element 268 urges against the bottom surface 274 of the ratchet 248, the ratchet 248 pivots about the shaft 250, thereby disengaging the ratchet arms 252, 254 from the pawls 244, 246. Consequently, the springs 236, 238 are permitted to rapidly force the piston 226 into the water cylinder 222, thereby expelling water through the nozzle 224. The operation and construction of the water gun 210 is in all other essential respects identical to the operation and construction of the water gun 10 shown in FIGS. 1–6.

While the particular water gun as herein shown and described in detail is fully capable of attaining the above-described objects of the invention, it is to be understood that it is the presently preferred embodiment of the present invention and is thus representative of the subject matter which is broadly contemplated by the present invention, that the scope of the present invention fully encompasses other embodiments which may become obvious to those skilled in the art, and that the scope of the present invention is accordingly to be limited by nothing other than the appended claims.

What is claimed is:

1. A water gun, comprising:

a housing;

a trigger movably connected to the housing between a ready position and a shoot position;

a water cylinder mounted on the housing, the water cylinder forming a chamber for holding water and having an end formed with an opening;

a piston slidably disposed in the chamber, the piston having a load position, wherein the piston is distanced from the opening, and a fired position, wherein the piston is adjacent the opening;

a spring operably engaged with the piston for urging the piston from the load position to the fired position in response to movement of the trigger to expel water from the chamber through the opening;

a release arm having a notch, the release arm being movably mounted on the housing, wherein the trigger moves the release arm when the trigger is moved toward the shoot position;

a flange formed on the piston; and a firing post attached to the flange for selectively engaging the notch of the release arm to hold the piston in the load position, wherein the firing post is released from the notch to permit the spring to move the piston toward the fired position when the trigger is moved toward the shoot position to move the release arm.

2. The water gun of claim 1, further comprising:

a water reservoir mounted on the housing; and a conduit for selectively establishing a pathway for fluid communication between the chamber and reservoir.

3. The water gun of claim 2, further comprising:

a conduit check valve disposed in the conduit for permitting one-way fluid flow from the reservoir to the chamber when the piston is moved toward the load position; and an opening check valve disposed in the opening of the cylinder for permitting one-way fluid flow from the chamber through the opening when the piston is moved toward the fired position.

4. The water gun of claim 3, further comprising:

a cocking member movably connected to the housing, the cocking member including a manually grippable handle having a cocked position and a shoot position.

5. The water gun of claim 4, wherein the cocking member includes a shaft connected to the handle, and a trunnion operably engaged with the shaft, such that the trunnion moves the piston from the fired position to the load position when the handle is moved from the shoot position to the cocked position.

6. The water gun of claim 5, further comprising a pawl movably mounted on the housing for preventing motion of the trigger when the handle of the cocking member is in the cocked position, and for permitting motion of the trigger when the handle of the cocking member is in the shoot position.

7. The water gun of claim 6, wherein the trunnion engages the pawl to move the pawl when the handle of the cocking member is moved toward the shoot position.

8. The water gun of claim 7, wherein the flange of the piston strikes the trunnion when the piston is moved to the fired position, thereby generating an audible indication of firing and a tactile sensation of firing.

9. The water gun of claim 4, further comprising a ratchet mechanism operably associated with the cocking member and piston and two springs operably engaged with the ratchet mechanism, wherein the ratchet mechanism has an engaged configuration and a released configuration, and the trigger can be operated to move the ratchet mechanism to the released configuration to permit the springs to urge the piston into the chamber.

10. The water gun of claim 1, further comprising a nozzle engaged with the opening of the cylinder for emitting water from the chamber through the nozzle in a burst pattern when the piston is moved to the fired position.

11. A device for emitting water, comprising:

a reservoir;

a liquid holder including a water cylinder formed with an opening and defining a chamber, the liquid holder having a fill configuration, wherein water from the reservoir can pass into the chamber, and an expel configuration, such that water is rapidly expelled from the chamber through the opening in a burst pattern when the holder is moved toward the expel configuration;

a firing mechanism operably engaged with the liquid holder for selectively causing the liquid holder to emit water from the chamber;

a housing for holding the liquid holder, wherein the liquid holder is biased to the expel configuration, and the firing mechanism selectively moves the liquid holder toward the fill configuration and selectively releases the liquid holder to permit the liquid holder to move toward the expel configuration, wherein the firing mechanism includes a trigger movably connected to the housing;

a piston slidably disposed in the chamber, the piston having a load position, wherein the piston is distanced from the opening, and a fired position, wherein the piston is adjacent the opening;

at least one spring operably engaged with the piston for urging the piston from the load position to the fired position in response to movement of the trigger to expel water from the chamber through the opening; and a ratchet mechanism operably associated with the piston and spring, wherein the ratchet mechanism has an engaged configuration and a released configuration, and the trigger can be operated to move the ratchet mechanism to the released configuration to permit the spring to urge the piston into the chamber.

12. The device of claim 11, further comprising a second spring operably associated with the piston and the ratchet mechanism.

13. The device of claim 11, wherein the firing mechanism further includes:

a manually grippable handle movably connected to the housing and having a cocked position and a shoot position;

a shaft connected to the handle; and a trunnion operably engaged with the shaft, such that the trunnion moves the piston from the fired position to the load position when the handle is moved from the shoot position to the cocked position.

14. The device of claim 13, wherein the trigger is biased to a ready position and can be manipulated to move toward a shoot position, and the firing mechanism further comprises:

a release arm having a notch, the release arm being movably mounted on the housing, wherein the trigger moves the release arm when the trigger is moved toward the shoot position;

a flange formed on the piston; and a firing post attached to the flange for selectively engaging the notch of the release arm to hold the piston in the load position, wherein the firing post is released from the notch to permit the piston to move toward the fired position by the spring when the trigger is moved toward the shoot position to move the release arm, and wherein the flange of the piston strikes the trunnion when the piston is moved to the fired position, thereby generating an audible indication of firing and a tactile sensation of firing.

15. A water gun, comprising:

a housing;

a trigger movably connected to the housing between a ready position and a shoot position;

a water cylinder mounted on the housing, the water cylinder forming a chamber for holding water and having an end formed with an opening;

a piston slidably disposed in the chamber, the piston having a load position, wherein the piston is distanced from the opening, and a fired position, wherein the piston is adjacent the opening;

a spring operably engaged with the piston for urging the piston from the load position to the fired position in response to movement of the trigger to expel water from the chamber through the opening;

a water reservoir mounted on the housing;

a conduit for selectively establishing a pathway for fluid communication between the chamber and reservoir;

a conduit check valve disposed in the conduit for permitting one-way fluid flow from the reservoir to the chamber when the piston is moved toward the load position;

an opening check valve disposed in the opening of the cylinder for permitting one-way fluid flow from the chamber through the opening when the piston is moved toward the fired position;

a cocking member movably connected to the housing, the cocking member including a manually grippable handle having a cocked position and a shoot position, wherein the cocking member includes a shaft connected to the handle, and a trunnion operably engaged with the shaft, such that the trunnion moves the piston from the fired position to the load position when the handle is moved from the shoot position to the cocked position;

a pawl movably mounted on the housing for preventing motion of the trigger when the handle of the cocking member is in the cocked position, and for permitting motion of the trigger when the handle of the cocking member is in the shoot position, wherein the trunnion engages the pawl to move the pawl when the handle of the cocking member is moved toward the shoot position;

a release arm having a notch, the release arm being movably mounted on the housing, wherein the trigger moves the release arm when the trigger is moved toward the shoot position;

a flange formed on the piston; and a firing post attached to the flange for selectively engaging the notch of the release arm to hold the piston in the load position, wherein the firing post is released from the notch to permit the spring to move the piston toward the fired position when the trigger is moved toward the shoot position to move the release arm.

* * * * *